United States Patent [19]

Nelson

[11] Patent Number: 4,498,955

[45] Date of Patent: Feb. 12, 1985

[54] CONTROL OF ACTIVE ALKALI IN BLACK LIQUOR

[75] Inventor: H. Wharton Nelson, West Hartford, Conn.

[73] Assignee: Combustion Engineering, Inc., Windsor, Conn.

[21] Appl. No.: 528,483

[22] Filed: Sep. 1, 1983

[51] Int. Cl.[3] ..... D21C 11/12

[52] U.S. Cl. ..... 162/30.11; 162/49; 162/62; 162/240; 162/263

[58] Field of Search ..... 162/49, 61, 62, 30.11, 162/263, 252, 240

[56] References Cited

U.S. PATENT DOCUMENTS 3,553,075 1/1971 Rivers ..... 162/62

4,322,266 3/1982 Nelson ..... 162/30.11

*Primary Examiner*—William Smith

*Attorney, Agent, or Firm*—Arthur L. Wade

[57] ABSTRACT

In the cycle for production of pulp by the Kraft process, the active alkali concentration range in black liquor is monitored and adjusted. In recognition of the effect of the proportion of the active alkali to the other contents of the black liquor on a dry solids basis, active alkali is adjusted to control various performances of the evaporators and combustion within the recovery furnace.

6 Claims, 2 Drawing Figures

*REPORTED AS % $NA_2O$ OF THE DRY SOLIDS

CONTROL OF ACTIVE ALKALI IN BLACK LIQUOR

TECHNICAL FIELD

Figure 1:
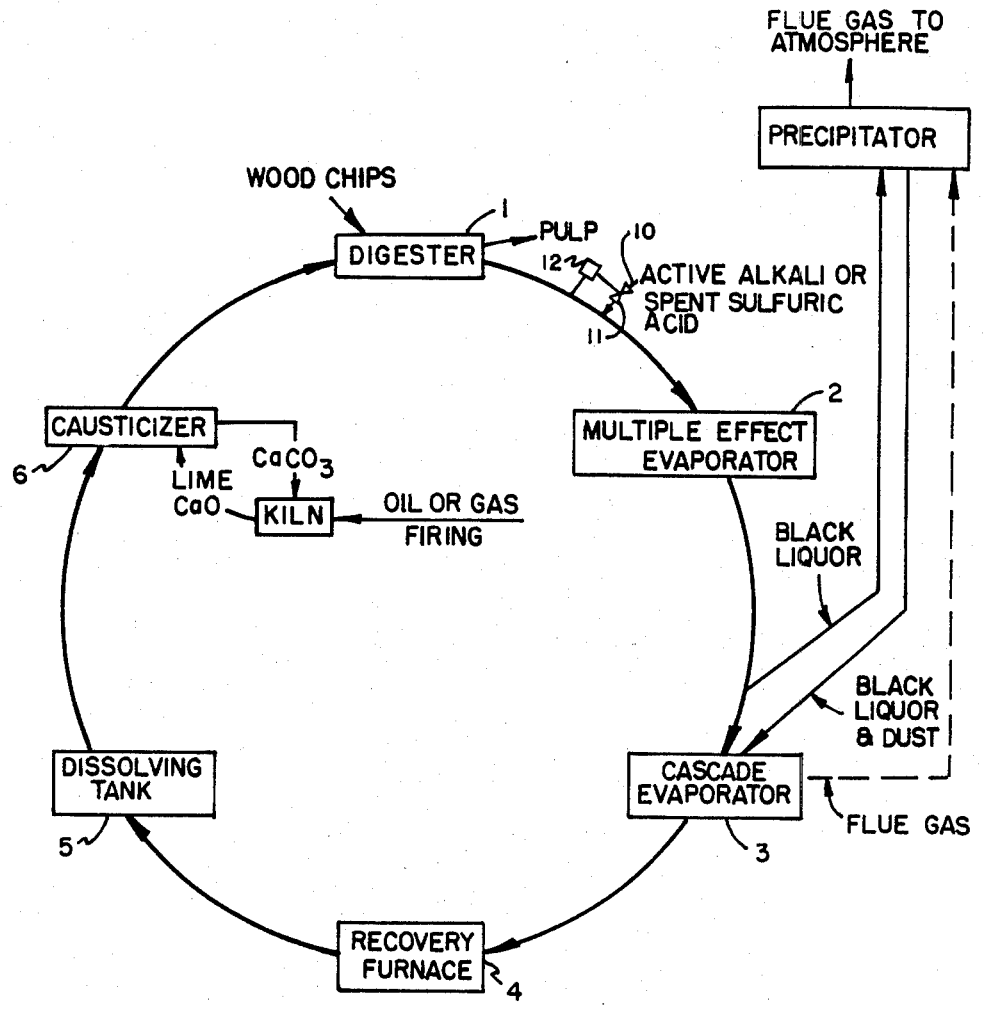

The invention relates to the control of the active alkali concentration in black liquor on its path through the chemical recovery process. More particularly, the invention relates to maintaining the desired range of active alkali concentration in the black liquor as it flows toward the furnace.

BACKGROUND ART

Transition From Soda To Kraft

The delignification reaction during digestion of wood chips in the Kraft pulping process preferentially dissolves the nonfibrous organic lignin "glue" which cements cellulose fibers together in the microstructure of the wood chips. Sodium hydroxide and sodium sulfide are the main pulping constituents (i.e., the active alkali) in white (cooking) liquour used for digestion in the Kraft process.

Historically, sodium hydroxide, alone, was first used by industry for pulping as was then termed the soda process. Unfortunately, the result was excessive losses of the desired cellulose, along with the lignin, caused by chemical degradation of large cellulose molecules due to the "peeling off" reaction. Specifically, small carbohydrate monomers peel off from the large polymeric cellulose molecule, causing rapid formation of water-soluble glucose derivatives and a water-insoluble cellulose molecule of decreased molecular weight. The yield of cellulose pulp was consequently decreased. The Kraft process was then substituted for the soda process despite the resulting disadvantages of Kraft's foul odors, metal corrosion, and explosions caused by the sulfur content of the cooking liquor.

The addition of about 20 percent sodium sulfide to the sodium hydroxide to form white liquor in the Kraft process, results in approximately a five percent increase in pulp yield, and in faster delignification and stronger pulp. Despite its limitations, the Kraft process remains a very versatile, widely-used process, and accounts for approximately 80 percent of the total pulp production in this country. The process continues to be improved in its odor and stands little chance of being replaced in our lifetimes, despite long continued research on alternate pulping schemes. The sodium sulfide apparently serves as both a buffer and pulping catalyst whose functions are still not well-understood.

Most of the sodium hydroxide is consumed during the digestion of wood chips in the Kraft process. The sodium sulfide, by contrast, is depleted to a much lesser degree, which substantiates that it has a role as a "catalyst" in the pulping reactions. About half of the residual active alkali, i.e., that remaining in the spent liquor (now black in color) from digestion, is consequently sodium sulfide, rather than sodium hydroxide, even though the proportions added in white (cooking) liquor were about 4:1 ratio of sodium hydroxide to sodium sulfide.

The concentration of residual active alkali remaining in weak black liquor depends on a number of operating variables in the digestion process. Some of these variables are: (1) sulfidity of the white liquor; (2) wood-to-active alkali ratio with which the digester is charged; (3) type of wood pulped; and (4) the severity of the cook, itself. Downstream from the digester, the active alkali concentration can be changed dramatically by subsequent processing steps on the liquor, such as exposure to hot acidic flue gases from liquor or oil firing in the furnace to eliminate water in the direct contact evaporator. Addition of extraneous by-product streams, such as spent sulfuric acid which is available from the manufacture of chlorine dioxide for bleaching of the pulp, to recover the sodium and sulfur values, can greatly decrease the active alkali concentration present in the black liquor stream as it flows to the chemical recovery furnace. The addition of spent pulping liquors from other pulping processes like sulfite, NSSC, etc., can also modify the active alkali level in the resulting blend. No known mill currently controls the active alkali level in black liquor aside from crude adjustments of its pH. The concentration of active alkali in black liquor consequently varies widely, even though its level is a significant factor in the physical and chemical behavior of the liquor in subsequent processing steps.

Evaporator Fouling

A marked affect of pH (and hence indirectly active alkali) on organic scale deposition rate in a multiple effect evaporator charged with mixed Kraft-NSSC black liquors has been established. Data have been recorded establishing the relationship between scaling rate of liquor-side heat transfer surfaces and liquor pH. Negative rates for some points show that deposited scale was removed at pH values above 12.9. Active alkali is thus indirectly established as an important variable on scaling rate of liquor-side heat transfer surfaces.

The following relationship between pH (indirectly related to active alkali) of black liquor and $H_2S$ emission in a cascade evaporator from partially oxidized black liquor was described as follows:

| $Na_2S$ (g/liter) | pH | $H_2S$ in Exit Flue Gas (ppm) |
|---|---|---|
| 1 | 11.5 | 130 |
| 1 | 12 | 100 |
| 1 | 12.45 | 60 |
| 1 | 12.65 | 30 |
| 3 | 12 | 500 |
| 3 | 12.45 | 300 |

The $H_2S$ content in flue gases leaving a cascade evaporator is thus a function of both active alkali (related to pH), and sodium sulfide concentration in unoxidized black liquor entering such a direct contact evaporator. Absorption of acidic $SO_2$ from flue gases would also be affected by pH or active alkali content of black liquor in the cascade. Higher concentrations of active alkali favor removal of $SO_2$ from the flue gas stream in a direct contact evaporator.

It has been reported that there is a difinite connection between cascade fires and active alkali level in the black liquor. When the active alkali becomes too low, either through addition of miscellaneous chemical side streams like spent sulfuric acid, or through prolonged exposure to highly acidic flue gases from oil firing, a severe drop in the pH can occur. Decreasing below about pH 12 causes formation of a voluminous precipitate of lignin from the black liquor. This lignin precipitate has a high organic content which is flammable once dried on the wheel. It then catches fire easily on contact with hot flue gas which has sufficient oxygen content to support combustion. One answer to this problem lies in maintaining sufficient active alkali at all times.

Viscosity Effects On Furnace Operation

A relationship has been determined between severe liquor-side wheel plugging problems in cascade evaporators, and low viscosity of the liquor. Plugging can result in downtime as often as once a week for cascade washing in some mills.

Another type of viscosity problem caused by too low an active alkali concentration is the "roping" of the liquor stream into the furnace through the liquor spray nozzles. The liquor stream does not break up into the usual discrete spray particles on passing into the furnace, but rather leaves each gun in the form of a continuous, unbroken rope-like stream which blacks out the furnace promptly if not corrected.

Active alkali content of liquor has a decisive effect on viscosity. The sharp variation of liquor viscosity with active alkali content of the liquor dry solids in some ranges of concentration has been established. For example, the viscosity of black liquor samples with 60 percent solids from a number of mills increased dramatically below 3.0 percent sodium oxide on a dry solids basis. Viscosity increased 300 percent when the active alkali decreased by 1.0 percent absolute, from 3.0 percent to 2.0 percent, in the liquor. By contrast, even wide variation in active alkali on liquor with 50 percent solids produced only a slight change in viscosity.

Chemical Effects of Active Alkali

It has been established in recovery boilers that both dust load and $H_2S$ emission in flue gas leaving the furnace depend strongly on active alkali concentration in the black liquor fired. The reason for the decided effect of active alkali in decreasing the dust load of flue gases leaving the furnace is that the sulfur in the $Na_2S$ fixes the sodium in a nonvolatile form. The sharp rise in $H_2S$ of flue gas with increasing active alkali in the black liquor, however, is due to the high $Na_2S$ content of active alkali in the liquor which is stripped of its sulfur content by the following reaction in flue gas atmosphere: $Na_2S+H_2O+CO_2 \rightarrow H_2S+Na_2CO_3$.

Occasional periods of difficulty in burning Kraft black liquor have been reported in some furnaces. These difficulties have been characterized by cold, inactive char beds, lowered steam flow, and frequent partial bed blackouts, i.e., by poor "burnability" of the black liquor common to all furnaces firing this liquor in a given mill. During these periods, water removal from the liquor could not be increased further in the direct contact evaporators, and proper char formation from black liquor in the furnace required the burning of expensive auxiliary oil. The percent solids in liquor from the multiple effect evaporators and in liquor entering the furnace were normal or slightly higher than normal. In each case, the addition of sodium hydroxide as solid flakes, or 50 percent solution, to strong black liquor entering the cascades relieved the difficulties.

Monitoring active alkali in the black liquor indicated a decreased concentration during times of liquor firing problems. However, at no time did the liquor pH fall to a range which would normally result in lignin precipitation, i.e., less than about 12.0 pH. No spent acid is added to the liquor stream. The pH level in black liquor evidently does not give a sufficient indication of its active alkali level, since pH does not change directly with active alkali concentration in the black liquor due to the presence of buffers.

It has been suggested that active alkali concentration has a decided effect also on the drying rate of strong black liquor and in the proportion of water removed from the liquor in both direct and indirect evaporators.

Summation

On control of active alkali concentration in the black liquor within suitable limits, a number of important benefits would be realized, including: (1) more stable viscosity, spray size consistency, drying rate, and burnability of black liquor entering the recovery boiler; (2) less fouling of indirect evaporators, the concentrator, and cascades; (3) stabilization of bed-burning rate, increase of reduction efficiency, and the emission of less sulfur-containing gaseous air pollutants from the furnace.

DISCLOSURE OF THE INVENTION

The present invention contemplates measurement of the active alkali concentration in weak black liquor from the digester of the Kraft pulping process and maintaining the concentration of active alkali in the weak black liquor above 3% on a dry solids basis.

The invention further contemplates the detection of the active alkali concentration. of weak black liquor from the digester of the Kraft pulping process and adjustment of it in the black liquor within a range of 3 to 6% on a dry solids basis.

The invention further contemplates maintaining the active alkali concentration in weak black liquor by the introduction of spent sulfuric acid or sodium hydroxide, or white liquor as required to adjust the active alkali concentration in the black liqour stream to the desired range above 3%.

The present invention identifies an important black liquor compositional variable, active alkali, which is currently allowed to range over broad limits and thereby create costly operating problems in the evaporators and recovery furnace of a Kraft chemical recovery cycle. The invention obviates these problems by the control of active alkali within the concentration limits above 3%.

Other objects, advantages and features of this invention will become apparent to one skilled in the art upon consideration of the written specification, appended claims, and attached drawings.

BRIEF DESIGNATION OF THE DRAWINGS

Figure 2:
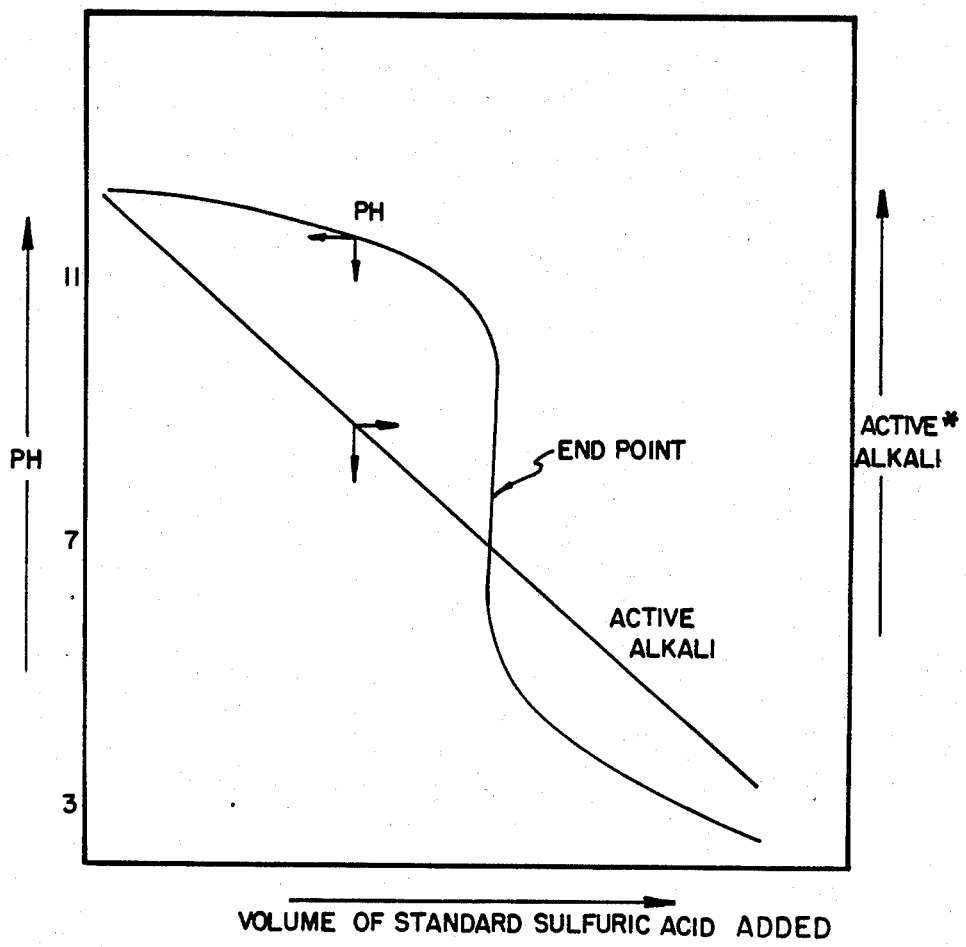

FIG. 1 is a diagram of the Kraft pulping process cycle in which is indicated the embodiment of the invention; and FIG. 2 is a graph of the relationship between pH and active alkali in black liquor of the pulping cycle.

BEST MODE FOR CARRYING OUT THE INVENTION

FIG. 1 is basically a block diagram indicating the main components through which the black, green, and white liquors flow in the so-called Kraft pulping process. To implement the invention, a position in the cycle is indicated at which the active alkali concentration in the black liquor is detected or sensed, continuously or periodically, and chemicals are added to adjust the proportion of active alkali in the black liquor stream under the teachings of the present invention. The process is best understood by beginning with the digester 1 in which wood chips are cooked in the kraft white liquor of sodium hydroxide and sodium sulfide with weak black liquor separated from the digester flowing to the multiple effect evaporator 2 where the water of the weak black liqour is reduced by evaporation. From the multiple effect evaporator 2, the liquor is indicated as flowing to the cascade evaporator 3 for further reduction of the aqueous phase of the black liquor. In modern mills, the cascade evaporator is replaced with a concentrator.

Now classified as "heavy" black liquor, the flow is into the recovery furnace 4. One product of the recovery furnace is smelt which is drained continuously into the dissolving tank 5 to form the green liquor. The green liquor then flows through the causticizer 6 to be converted into white liquor for use in digester 1. Thus, in broad brush strokes, the cycle of the Kraft process is indicated in FIG. 1 and a disclosure of the invention can proceed.

The addition of spent sulfuric acid to the black liquor stream, sometimes at the entrance of the multiple effect evaporator, is a crude standard procedure in the prior art. The pH of the resulting mixture is spot-checked and manual adjustments made in the rate of acid addition in order to dispose of the waste acid without causing lignin precipitation, for the purpose explained in the Background Art. However, as emphasized in the Background Art, these occasional pH measurements are not a realistic guide to the concentration of residual active alkali in the weak black liquor going into the evaporators and recovery furnace. The use of convenient pH measurements on the black liquor is sufficient to predict lignin precipitation caused by the addition of too much acid. The pH, however, does not indicate the concentration of active alkali since the relationship between the two is a complex one, strongly modified by the presence of normal buffers in the liquor. For instance, FIG. 2 shows that pH can change either slightly or precipitously on the addition of equal volumes of acids to black liquor, depending on how close the end point is approached. Active alkali concentration, by contrast, is a linear function unaffected by buffering. Equally important, it has been found that the active alkali concentration, more accurately the pH, relates to the physical and chemical behavior of the black liquor all along its path from the digester and into the final drying and burning processes in the furnace.

Continuous measurement must be made of the residual active alkali in the weak black liquor stream. An adjustment must be made to bring this concentration of active alkali to at least above 3% on a dry solids basis. This is what the invention comes down to: deliberate, conscious, and systematic control of the active alkali concentration in the liquor stream as it flows from the digester, through the evaporators, and into the recovery furnace.

Desirable Range of Active Alkali Contained In Black Liquor

Field data from several mills identify the concentration of active alkali in black liquor entering the cascades which causes a sharp increase in viscosity of firing strength kraft black liquor. The lowest practical active alkali operating level for the black liquor from kraft pulping of North American woods is 3.0% active alkali as sodium oxide on a dry solids basis. The automatic controller would, therefore, supply extra active alkali to the black liquor stream when required to bring the concentration up above this level.

The upper limit of active alkali concentration of black liquor in each mill would have to be set by mill experience with the particular black liquors produced. A level much above 6.0% active alkali is not economical for most mills, except those making dissolving pulp. The range between 3, the firm lower limit for kraft liquors, and 6 could, therefore, be narrowed by operating tests on the evaporators and furnace to fix the upper active alkali concentration limit for that particular mill's wood furnish and operating conditions. If the active alkali level were too high, the automatic controller would add spent sulfuric acid or other acid streams to the black liquor to adjust its concentration within the optimum range.

FIG. 1, a diagram of the kraft pulping and recovery cycle, indicates one point at which the spent acid or active alkali (white liquor) could be added to the black liquor stream. The adjustment of active alkali level would be made automatically, based on results from an in-line analyzer which continuously measures the residual alkali level in the weak black liquor stream. Mix tanks, agitators, and other types of equipment well-known in the chemical processing industry, might also be required to blend the streams properly with incoming black liqour. Although such additions could be made to the black liquor stream at any point before the furnace, it would be more expeditious to add them upstream of the multiple effect evaporator to decrease the fouling rate of their heat transfer surfaces and increase the evaporation rate there, and also, in the cascades or other evaporator downstream. Weak black liquor is the least viscous and so would blend easier with the added streams.

One might think of adjusting the active alkali concentration in weak black liquor leaving the digester by simply regulating the alkali-to-wood ratio entering the digester and/or the cooking conditions. In fact, however, the manipulation of this ratio may reduce the pulp yield, lower the Kappa number, or damage the pulp quality. Consequently, adjustment of the active alkali level in the black liquor appears to be a more feasible approach.

Structurally, the invention is embodied in a source 10 of active alkali and/or acid connected to the weak black liquor stream from the digester. A valve 11 is in the connection to control the amount of alkali and/or acid added under the control of detector 12 which is also connected to the weak black liquor stream. With this structure, or its equivalent, the active alkali concentration of the weak black liquor stream is regulated in accordance with the invention.

Conclusion

With the foregoing control of the active alkali concentration in the weak black liquor, within suitable limits, flowing from the digester, a number of important benefits will be realized, including: (1) more stable viscosity, spray size consistency, drying rate, and burnability of black liquor entering the recovery boiler; (2) less fouling of indirect evaporators, the concentrator, and cascades; (3) stabilization of bed-burning rate, increase of reduction efficiency, and the emission of less sulfur-containing gaseous air pollutants from the furnace.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A Kraft process for producing pulp by dissolving lignin with a mixture of sodium hydroxide and sodium sulfide, including, cooking wood chips in a digester containing sodium hydroxide and sodium sulfide, drawing weak black liquor from the digester, determining the concentration of active alkali in the weak black liquor on a dry solids basis, generating a control signal proportional to the concentration of active alkali, controlling the addition of alkali and/or acid to the weak black liquor flowing from the digester in accordance with the measurement of active alkali concentration to maintain the active alkali concentration at or above 3%.

2. The process of claim 1, wherein, the addition of alkali/acid is controlled to maintain active alkali concentration within a range of 3 to 6% on a dry solids basis.

3. The process of claim 1, wherein, the determination of the active alkali concentration is made upstream of the addition of alkali or acid to the black liquor stream.

4. In a Kraft pulping system circulating black liquor from a digester through evaporators for smelt recovery in a furnace, a control system for the active alkali concentration, including, means arranged responsive to the concentration of active alkali in the black liquor flowing from the digester and generating a control signal proportional to the active alkali concentration on a dry solids basis, a source of alkali and/or acid connected to add the alkali/acid to the weak black liquor flowing from the digester, and means for controlling the amount of alkali/acid added from the source and responsive to the control signal of the responsive means to maintain the percentage of active alkali in the weak black liquor at 3% or above.

5. The control system of claim 4, in which, the source of alkali/acid is controlled to maintain the active alkali concentration in the weak black liquor within the range of 3 to 6% on a dry solids basis.

6. The control system of claim 4, wherein, the means responsive to the active alkali concentration is connected to the weak black liquor upstream of the connection between the source of alkali or acid and the weak black liquor.

* * * * *